United States Patent [19]

Saligny

[11] Patent Number: 4,614,396

[45] Date of Patent: Sep. 30, 1986

[54] ELECTRICAL CONNECTION DEVICES

[75] Inventor: Yves Saligny, Cluses, France

[73] Assignee: Carpano & Pons, France

[21] Appl. No.: 578,203

[22] Filed: Feb. 8, 1984

[30] Foreign Application Priority Data

Feb. 15, 1983 [FR] France ..... 83 02888

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 4,127,312 11/1978 Fleischhacker et al. ..... 339/99 R 4,210,378 7/1980 Baribeau ..... 339/97 R

*Primary Examiner*—Joseph H. McGlynn

*Attorney, Agent, or Firm*—Darby & Darby

[57] ABSTRACT

A connection device includes a tubular connection member supported by an individual insulating support. The tubular connection member has a second end with dimensions so that it is able to receive the first end of another tubular connection member. A slot is formed in the second end and a slot is formed in the first end. The slots are adapted to receive a cable. The two tubular members are housed inside two half-sockets and an intermediate half-socket. The three half-sockets are housed in a common insulating case. The second tubular connection member may have a second slot formed in its second end which can grip another cable.

19 Claims, 26 Drawing Figures

ELECTRICAL CONNECTION DEVICES

The present invention relates to connection devices, comprising at least one tubular connection member, which conducts electricity and is supported by an electrically insulating support, a member whose first and second end parts, which are opposite each other, respectively comprise a first and second transverse slot constituting self-stripping connection means each able to receive at least one cable, a passage being provided in the insulating support, facing at least the second transverse slot, in order to house the cable therein.

Known connection devices of this type have a certain number of drawbacks. In fact, they are provided for a very specific use and are not absolutely polyvalent. Thus, only single-core cables can be connected therein and still require the use of a special set of tools. The connections made are solely of a temporary nature and the connection means used do not absolutely facilitate making connections which can both be disconnected easily for frequent use as well as permanent or semi-permanent. It is therefore necessary to use specific connection means for different applications. For example, a permanent connection is made by soldering or crimping, a semi-permanent connection is made by wrapping, a temporary connection is made with a self-stripping plug and a connection for frequent use is made by insertion. Thus, starting with a single basic connection unit, the connections means of the prior art do not make it possible to resolve all the problems which occur in connections as regards the type of contact obtained, but in addition they are not modular and thus cannot make it possible to produce at will various connection devices which can be used in different areas. On the other hand, nothing is provided for ensuring improved insulation between the various connection devices arranged side by side on their common insulating support, each device not being tight with regard to humidity and corrosive vapours. Finally, the connection of the cables to the two opposite ends of each self-stripping tubular member requires intervention by the operator, on the two opposite sides of the insulating support supporting these connection devices, which is very troublesome when this insulating support is fixed and occupies a relatively large surface area.

It is an object of the present invention to provide an electrical connection device in which the above-mentioned problems are obviated or substantially mitigated.

According to a first aspect of the present invention there is provided an electrical connection device, comprising at least one tubular connection member, which conducts electricity, supported by an electrically insulating support, a member whereof the first and second end parts, which are opposite each other, respectively comprise a first and second transverse slot constituting self-stripping connection means each able to receive at least one cable, a passage being provided in the insulating support, facing at least the second transverse slot, in order to house the cable therein, characterised in that the tubular connection member has a first split end part whereof the outer transverse dimensions are such that it is able to penetrate the second split end part of another tubular connection member, similar to the first, guide means being provided between at least an inner part of the insulating support and each tubular connection member which it supports, in order to allow a relative axial but non-angular movement between the insulating support and each tubular member, movement means being provided, for each tubular connection member, to facilitate this relative axial movement, the connection, respectively the connection and disconnection, between at least one of the two transverse slots of the latter, which slot extends across the two opposite walls of the latter and at least one cable located in the corresponding passage which extends transversely with respect to the insulating support in the extension of each of the two ends of the transverse slot.

In fact, this connection device is polyvalent since all the cables, both single-core as well as multi-core are able to be connected in the latter without a special set of tools and all types of connections, starting with a single basic connecting unit, can be made easily, namely a permanent connection, a semi-permanent connection which can be changed a dozen times for example, a temporary connection which can be changed a hundred times for example, a connection for frequent use, which can be disconnected at will an even greater number of times. In addition, this connection device is modular and thus makes it possible to produce various connection devices at will, which can be used in various areas, always starting with a single basic connecting unit. On the other hand, the electrical characteristics are greatly improved with respect to those of the prior art, as regards the individual insulation of each of the connection devices, in order to ensure that each of the latter is tight with regard to humidity and corrosive vapours. Finally, the connection of the cables to the two opposite ends of each self-stripping tubular member is greatly improved since the operator only has to work on a single face of the insulating support which supports the connection devices, and this is so whatever the type of connection made, permanent or otherwise and whatever the type of connection device produced and the area of application in question.

The present invention also relates to a method for the manufacture of the connection device and more precisely a method for the manufacture of the tubular connection member, which member constitutes one of the essential parts of the device.

Known tubular connection members of this type are generally made from a metal strip from which a blank is cut off, which is then wound in order to form a tube which is thus split over its entire length to form a longitudinal slot. Self-stripping transverse slots are provided in the blank, before winding, or sometimes are constituted by the two ends of the longitudinal slot. In this latter case, it is advantageous to provide, in the central part of the connection member, transverse slots opening into the longitudinal slot, in order to prevent the connection of a cable at one end of the connection member from preventing the subsequent clamping of another cable, at the other end of the connection member. It will be noted that the sets of tools necessary for producing a member of this type are relatively complicated since they comprise at least one cutting tool, which must produce a cutout blank of relatively complex shape.

According to a second aspect of the present invention there is provided a method for the manufacture of an electrical connection device characterised in that the self-stripping slots provided transversely on the two opposite extreme parts of the tubular connection member are provided by forming recesses in a direction parallel to the tubular connection member by means of a blade or a wire held rigidly and transversely with respect to this member.

The present invention thus proposes to facilitate the simplified production of a tubular connection member, without using a complex cutting-out tool and possibly without a winding tool since the above method can be implemented with a tubular blank closed over its entire periphery, obtained from a very long tube.

The accompanying drawings illustrate, by way of example, embodiments of the connection device, according to the present invention as well as a corresponding method of manufacture.

Figure 1:
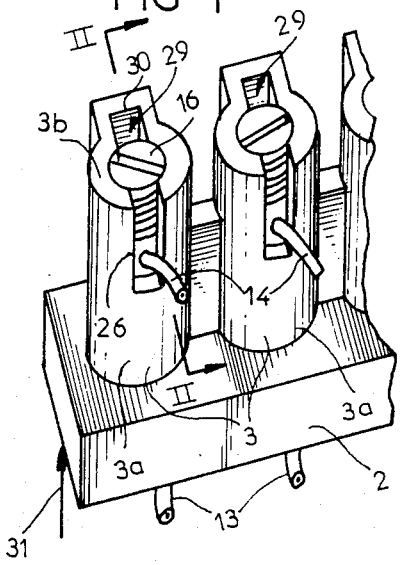
FIG. 1 shows in perspective view a first embodiment of the connection device.

As illustrated in FIGS. 1 to 5, the connection device comprises a tubular connection member 1, which conducts electricity, supported by an electrically insulating support 2 (FIG. 1) which is includes an insulating case 3 and an attached insulating socket 20.

The first and second end parts, respectively 11 and 12, which are opposite each other, of the tubular connection member 1, respectively comprise a first and second transverse slot 11*a* and 12*a* forming self-stripping connection means each able to receive at least one cable, respectively 13 and 14. The first end part 11 has external transverse dimensions such that it could be received by the second end part 12 of another tubular connection member identical to the first.

The insulating socket 20 is formed as a first and a second half-socket, respectively 21 and 22, intended to be placed one against the other, holding the tubular connection member 1 in position axially therebetween, in a housing 23 (FIG. 2) of corresponding cross-section, whereof the first end 23*a* is closed off completely and whereof the second end 23*b* is closed off only partly by a circular collar 24. The second half-socket 22 contains longitudinally solely the second end part 12 of the tubular connection member 1. The first half-socket 21 contains longitudinally the first end part 11 of the same member 1 and the part 15 for connection to the second corresponding end part 12.

Guide means are provided between the inner housing 23 of the insulating socket 20 and the tubular connection member 1 which it supports, in order to allow a relative axial but not angular movement between the insulating socket 20 and the corresponding tubular connection member 1. These means for axial guidance are formed for example by the corresponding outer contours of the member 1 and of the socket 20, having contours which are not circular, for example oval (FIG. 13) and thus prevent any relative angular movement.

The two half-sockets 21 and 22 are able to move axially, but not angularly, in the insulating case 3 of corresponding cross-section, whereof the first end 3*a* is integral with the insulating support 2 (FIG. 1), of which the case forms part. The angular movement of the two half-sockets 21 and 22 in the case 3 is prevented by an extension 29 (FIG. 1) provided on each half-socket which furthermore has a circular shape in this particular embodiment. Extension 29 is housed in a recessed extension 30 having a corresponding contour and provided longitudinally in the case 3. The half-sockets thus can only move axially in the case. An abutment 4 limits the axial movement of the first half-socket 21 in the direction of the first end 3*a* of the case 3, as indicated to be in the direction of arrow 5. Passages 6,7 extend respectively transversely with respect to the half-sockets 21 and 22, in the extension of each of the two ends of the transverse slots, respectively 11*a* and 12*a*. In this embodiment, these passages are formed by orifices closed over their entire periphery. In this example, one of the end parts 7*a* of the passage 7 is bent in order to emerge on the parting plane between the half-socket 22 and the half-socket 21 against which it is placed and is extended by a housing 22*a* provided in the latter. An end part 6*a* of the passage 6 is bent in the same way and emerges in the direction of the first end 3*a* of the case 3. Movement means are provided in order to ensure individually the connection between each transverse slot 11*a*,12*a* of the tubular connection member 1 and a cable, respectively 13, 14, by the relative axial movement between each end part 11,12 of the tubular connection member 1 and the corresponding half-socket, respectively 21,22. The second end 3*b* of the case 3, opposite the first end 3*a*, contains such movement means which comprise an operating screw 16 cooperating with a screwthread 17 provided internally in this second end 3*b* of the case 3. This screw 16 is able to exert a pressure in the direction of arrow 5 on the collar 24 of the second half-socket 22. In this embodiment, the passages 6 and 7 also form part of the movement means.

A recess 26 is provided through the wall of the case, facing the second end part 7*b* of the transverse passage 7 in the second half-socket 22. This recess is intended to allow the introduction, in the direction of arrow 27 (FIG. 5) of the cable 14 into the passage 7. It is advantageously extended in order to emerge at the second end 3*b* of the case 3.

The end of the first end part 11 of the tubular connection member 1 and the base 23*a* of the inner housing 23 of the first half-socket 21, which receives said first end part 11, are in the form of cones, respectively 8 and 9, in order to cooperate one with the other when the first end part 11 is inserted fully in the housing 23 of the first half-socket 21. It is the purpose of this arrangement to partially seal the slot 11*a* on the cable 13, by a permanent deformation, in this example, of the first end part 11. In addition, in this embodiment, the conical base 9 of the inner housing 23 of the first insulating half-socket 21 comprises a central axial part 28 (FIG. 2) in the shape of a mushroom, arranged to wedge the first end part 11 between the conical base 9 and the mushroom-shaped part 28, when this first end part 11 is fully inserted, in order to connect the said first end part 11 to the insulating support constituted by the first half-socket 21.

The connection device described above may be arranged in multiples (FIG. 1) for example in order to form a connection strip which can be used in particular for distribution or sub-distribution in telecommunications. In an application of this type, each case 3 may have an outer diameter of 5–10 mm for example, each tubular connection member 1 having a wall thickness of 0.3–0.4 mm, each slot 11*a*,12*a* having a width of 0.2–0.3 mm for example.

Figure 2:
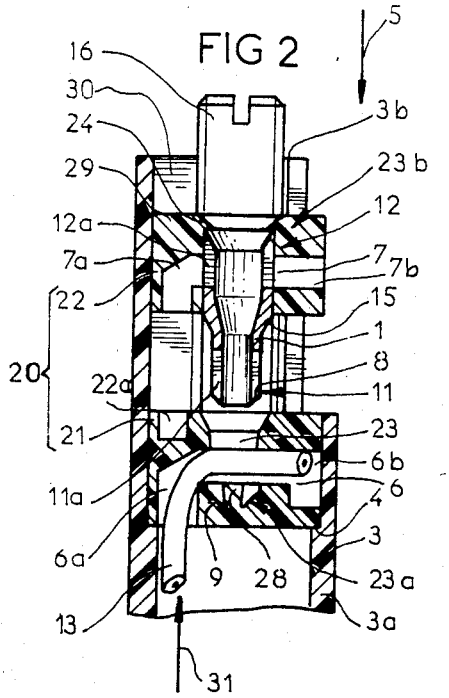
FIGS. 2, 3, 4 and 5 show the same first embodiment, at different stages of use, seen in section on line II—II of FIG. 1.

The cables 13 and 14 are connected in the following manner: When the operating screw 16 and the two half-sockets 21 and 22 have been removed from the case 3, the cable 13 is introduced in the direction of arrow 31 (FIGS. 1 and 2) through the lower part of the insulating support 2 and the first part 3*a* of the case 3. The cable 13 is then introduced into the transverse passage 6, adjacent the end 6*a* of the latter, and its part projecting beyond the second end 6*b* is cut off manually with cutters. Then, as illustrated in FIG. 2, the first half-socket 21 is introduced into the case 3 bearing against the abutment 4, the second half-socket 22 containing the tubular connection member 1 is introduced in the direction of arrow 5 into the case 3 until the transverse slot 11*a* engages on the cable 13.

Figure 3:
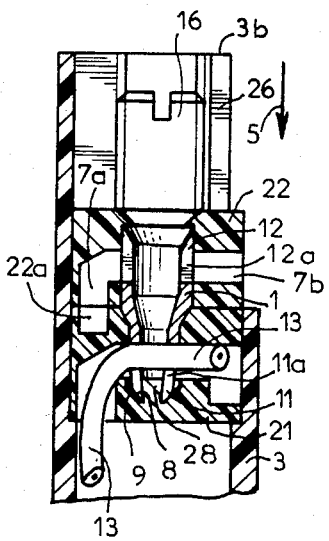

The screw 16 is then screwed into the screwthread 17, which pushes the first half-socket 21 in the direction of arrow 5 and, as shown in FIG. 3, the cable 13 is driven into the transverse slot 11*a*. When the first end part 11 is fully inserted, it is wedged between the conical base 9 and the mushroom-shaped part 28 (FIG. 3). The slot 11*a* is simultaneously tightened at its entrance, the cable 13 being held in position in a permanent manner in the slot 11*a*.

Figure 4:
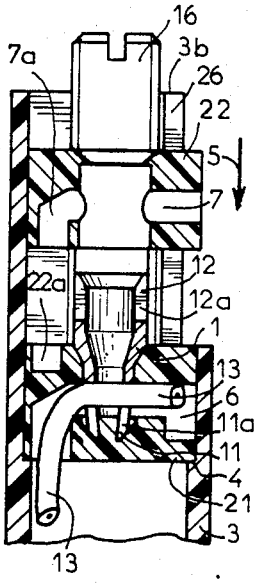

As shown in FIG. 4, the screw 16 is then unscrewed and the second half-socket 22 is moved back in the opposite direction of arrow 5 until it is disengaged from the second end part 12 of the tubular connection member, which remains connected to the cable 13, and from the case 3.

Figure 5:
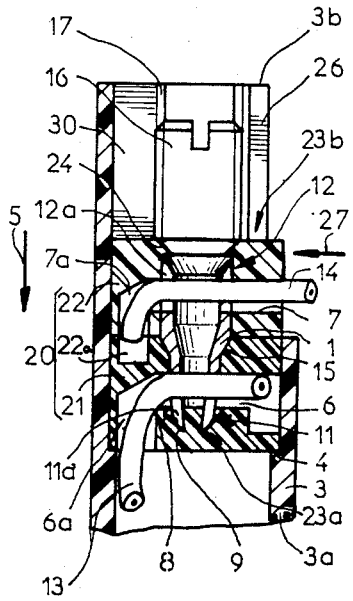

The cable 14 is then introduced in the direction of arrow 27 (FIG. 5) into the transverse passage 7 and its end projecting beyond the first end 7*a* of the latter is cut off with cutters. The second half-socket 22 is then once more engaged on the second end part 12 and pushed in the direction of arrow 5 by the screw 16 until the cable 14 is introduced fully into the second transverse slot 12*a*, as shown in FIG. 5. The end of the cable, cut previously, is housed in the housing 22*a*.

In the case where several connection devices constitute a connecting strip, each cable 13 defines an "input" wire connected permanently and each cable 14 defines an "output" wire connected provisionally. In fact it is possible to unscrew the screw 16 at will and to withdraw the second half-socket 22 in the direction opposed to arrow 5, with the bit of a screwdriver for example, which disconnects the cable 14. The latter may then be connected, for example, to another tubular connection member 1 already fitted on another cable 13.

Figure 6:
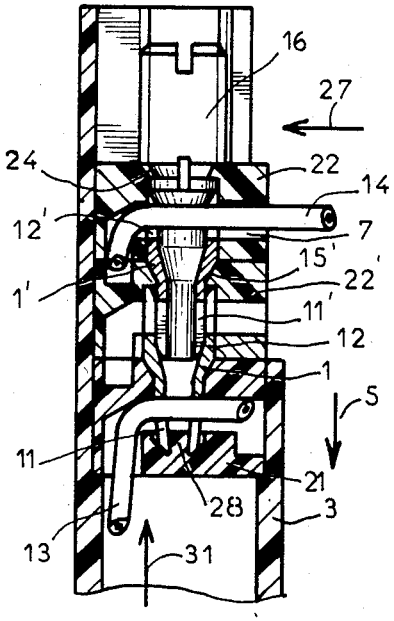
FIG. 6 shows a first variation of the first embodiment, in section on line II—II of FIG. 1.

In the first variation, illustrated in FIG. 6, the operating screw 16 has its end directed towards the second half-socket 22 which is clipped onto the collar 24 of the latter, while being able to rotate with respect to the latter.

As shown in FIG. 6, this variation comprises at least one intermediate half-socket 22' similar to a second half-socket 22, which is interposed between the first and second half-sockets 21 and 22. The inner axial housing of this intermediate half-socket 22' is shaped to contain at its first end, the second end part 12 of a first tubular connection member 1 and at its second end, the connecting part 15' of a second tubular connection member 1' whereof the first end part 11' is inserted in the second end part 12 of the first tubular connection member 1.

All the other constituent parts are identical to those of the first embodiment previously described (FIGS. 1 to 5).

The three first stages of use of the connection device take place as described in the first embodiment (FIGS. 2 to 4) in order to connect the cable 13 by crimping the first end 11 against the mushroom-shaped part 28. The withdrawal of the screw 16 in the opposite direction to the arrow 5 has caused the withdrawal of the second half-socket 22 which is clipped on the latter. The screw 16 and half-sockets 22 are thus outside the case 3.

The intermediate half-socket 22' is introduced in the direction of arrow 5 into the case 3 on the second end part 12 of the tubular connection member 1. The cable 14 is then introduced in the direction of arrow 27 into the passage 7, and its end is cut as described previously. Then the second half-socket 22 is once more introduced into the case 3 and, under the action of the screw 16, the cable 14 is driven in the direction of arrow 5 into the transverse slot in the second end 12' of the second tubular connection member 1' (FIG. 6).

Several connection devices according to FIG. 6 may form for example a connecting strip "with cut off ". Each cable 13 constitutes an "input" wire connected positively and each cable 14 constitutes an "output" wire which can be disconnected and reconnected very frequently. In order to disconnect it, it is sufficient to unscrew the operating screw 16, which entrains in the opposite direction to arrow 5 the second half-socket 22 and the second end part 12' to which the cable 14 remains connected. Disconnection between the cables 13 and 14 thus takes place between the end parts 11' and 12 of the two tubular connection members 1' and 1, which in this example constitute a connector which can be disconnected and connected a very great number of times.

Figure 9:
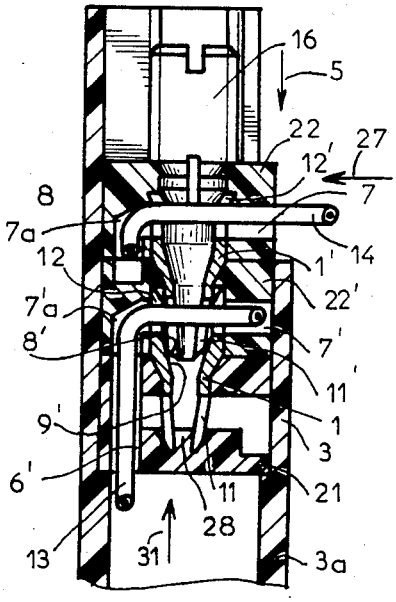

In the second variation, shown in particular in FIG. 9, the second end part 12' of the second tubular connection member 1' is rendered integral with the second half-socket 22, for example by crimping, as described hereafter. The end part 7'*a* of the passage 7' extending transversely with respect to the intermediate half-socket 22' is bent in order to emerge on the end of this half-socket 22', and is directed towards the first end 3*a* of the case 3. It is extended by a passage 6' extending longitudinally through the first half-socket 21 in the direction of this first end 3*a* of the case 3.

The respective longitudinal dimensions of the first end part 11,11', the second end part 12,12', and respectively each of the two tubular connection members 1 and 1' are such that, when the first end part 11' of the tubular member 1' is fully inserted in the second end part 12 of the other tubular connection member 1, the first slot in the first end part 11' and the second slot in the second end part 12 are arranged transversely one as an extension of the other in order to be able to be connected together to at least one cable 13.

In addition, the base of the inner part of the second end part 12 of the tubular connections member 1 and/or the end of the first end part 11' of the other tubular connection member 1', which is housed in the second end part 12, are in the form of cones, respectively 9',8', in order to cooperate one with the other when the first end part 11' of the other tubular connection member 1' is fully inserted in the inner part of the second end part 12 of the first tubular connection member 1, in order to reclose at least partially, in a resilient manner, the transverse slot in the first end part 11' over a cable 13.

All the other constituent parts of this embodiment are identical to those of the first variation described previously (FIG. 6).

Figure 7:
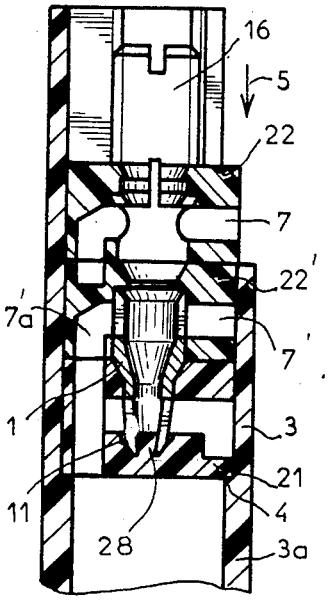
FIGS. 7 to 9 show a second variation of the first embodiment, at different stages of use, in section on line II—II of FIG. 1.

The initial positions of the components of the connector are illustrated by FIG. 7. The three half-sockets 21,22' and 22 are located in the case 3 in the order just recited, with the first socket 21 bearing against the abutment 4. The a tubular connection member 1 is housed, in the first half-socket 21 and in the intermediate half-socket 22'. When the screw 16 is fully locked, the various parts occupy the position shown in FIG. 7, the first end part 11 of the tubular connection member 1 being kept wedged below the mushroom-shaped part 28.

The screw 16 and the second half-socket 22, as well as the intermediate half-socket 22', are then withdrawn in the opposite direction to arrow 5. The cable 13 is introduced in the direction of arrow 31 into the orifice 6'. Then the cable is introduced into the orifice 7' of the intermediate half-socket 22' which, after cutting off the end of the cable 13 projecting beyond this orifice 7', is fitted on the second end part 12. The second half-socket 22 and its screw 16 are placed against the intermediate half-socket 22' then are moved in the direction of arrow 5 in order to reach the position occupied in FIG. 8, in which the cable 13 is driven into the second transverse slot **12*a* in the second end part 12**.

The screw 16 and the second half-socket 22 are once more withdrawn in the opposite direction to arrow 5. The first end part 11' of the second tubular connection member 1' is then brought into contact with the cable 13 in the second end part 12. The cable 14 is introduced in the direction of arrow 27 into the passage 7 and cut at the end **7*a* of the latter. The second half-socket 22 and its cable 14 are presented to the entrance of the second slot in the second end part 12' of the second tubular connection member 1'. When the screw 16 finishes moving the secnd half-socket 22 fully, the second end part 12' is moved away and integrally crimped in this second half-socket 22 (FIG. 9). At the same time, the first end part 11' is closed in a resilient manner partially (FIG. 9) around the cable 13 under the action of the cone 9'**.

Figure 8:
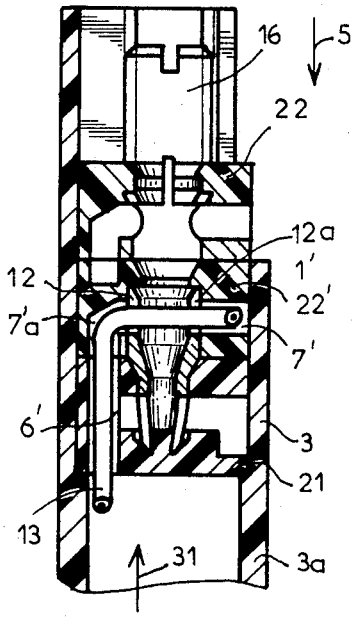

Several connection devices, according to FIGS. 7 to 9, form for example another model of a connecting strip "with cut off". In each connection device, by loosening the screw 16, it is possible to disconnect from the cable 13 the second tubular connection member 1' which remains connected to the cable 14. The connection between the cable 13 and the second end part 12 is permanent. The connection between the cable 13 and the first end part 11' is semi-permanent. It should be noted that these parts 12 and 11' are both connected directly to the cable 13 without an additional intermediate contact point.

Figure 10:
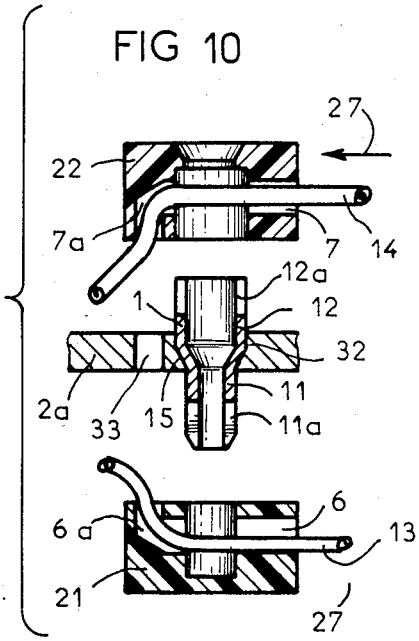
FIGS. 10 and 11 show a third variation of the first embodiment, at various stages of use, in section.
Figure 11:
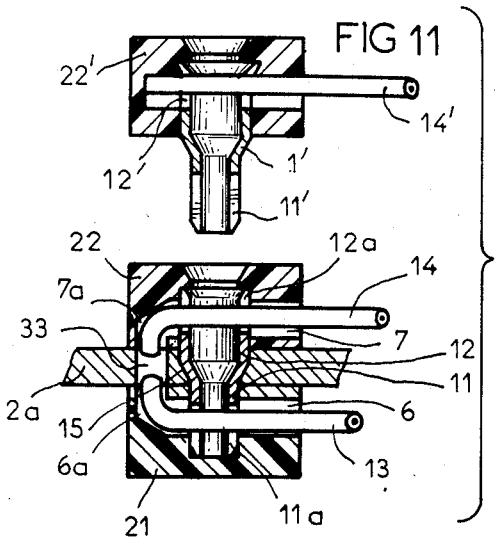

In the third variation, illustrated in FIGS. 10 11, a part **2*a* of the insulating support 2, supporting several insulating sockets 20, is interposed between the two half-sockets 21,22 constituting each insulating socket 20. This part 2*a* comprises housings 32 (FIG. 10) passing through the latter from one side to the other, each housing 32 being shaped in order to house at least the connecting part 15 existing between the two end parts 11,12 of different dimensions, of a tubular connection member 1. One of the two end parts, 6*a*,7*a* of the transverse passages 6,7 provided respectively in the two half-sockets 21,22 are bent in order to emerge on the parting plane between each half-socket 21,22 and the adjacent member, the insulating support 2*a*, against which they are placed. They are extended by a housing 33 provided across the adjacent member 2*a***.

Before connection, as illustrated in FIG. 10, the tubular connection member 1 is placed in its housing 32 and the cables 13,14 are introduced in the direction of arrow 27 respectively into the passages 6 and 7. The ends of the cables, which project respectively from the ends **6*a*,7*a*** of the passages, are cut off with cutters.

The cable 13 is then brought into contact with the first slot **11*a* in the first end part 11 and the cable 14 is brought into contact with the second slot 12*a* in the second end part 12**.

The connection of the two cables 13,14 to the tubular connection member 1 is finally obtained by moving the two half-sockets 21,22 towards each other either manually or with grippers. The ends of the cables 13,14 are housed in the housing 33. In this variation, the mushroom-shaped part 28 is for example not provided in the base of the first half-socket 21, and the first end part 11 is thus not closed over the cable 13.

Several connection devices, according to FIGS. 10 and 11, form for example a connecting strip "without cut off" in which the connections made are semi-permanent. In this example it is possible, as shown in FIG. 11, to introduce into the second end part 12 of the tubular connection member 1, a first end part 11' of a second tubular connection member 1' whose second end part 12' is connected to a cable 14' and is housed and crimped in another half-socket 22', which may be similar to the half-socket 22 of FIG. 9. These additional members for example define a "test" tap which may thus be connected temporarily to the cable 14.

Figure 13:
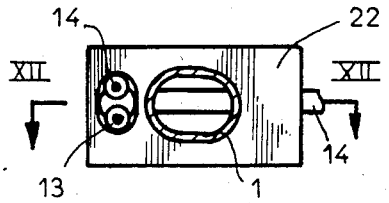
FIG. 13 shows the same fourth variation in section on line XIII—XIII of FIG. 12.
Figure 12:
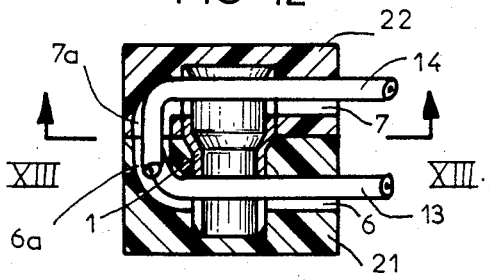
FIG. 12 shows a fourth variation of the first embodiment, in section on line XII—XII of FIG. 13.

The fourth variation, illustrated in FIGS. 12 and 13, represents a simple "splice" produced by means of a tubular connection member 1 housed in its two half-sockets 21,22 which in this example have a rectangular cross-section. This variation is similar to the former (FIGS. 10,11) in which the intermediate insulating support **2*a* would have been removed. The first bent end 6*a*,7*a* of the passage 6,7** emerge facing each other and each forms a housing for housing the end of the cable emerging from the other passage arranged in facing relationship.

Figure 14:
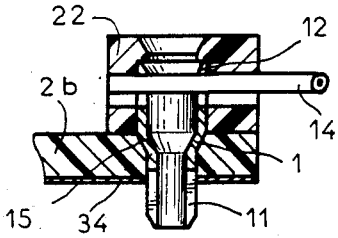
FIG. 14 shows a fifth variation of the first embodiment, in section.

The fifth variation, illustrated in FIG. 14, comprises solely a tubular connection member 1 on the second end part 12 to which a cable 14 is connected by means of a second half-socket 22. A connection device of this type may be used for example for connecting a cable 14 to a printed circuit 34 supported by an insulating support **2*b* in which is housed the connecting part 15 and a part of the first end part 11. The latter is connected to the circuit 34**.

Figure 15:
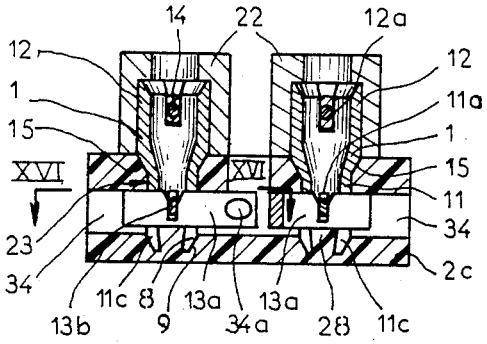
FIG. 15 shows a sixth variation of the first embodiment, seen partially in section on line XV—XV of FIG. 16.
Figure 16:
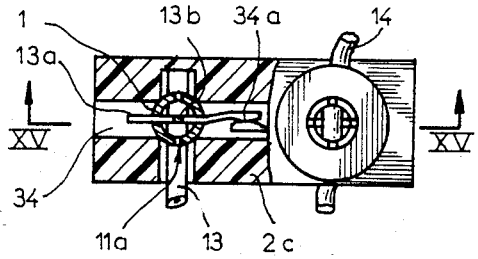
FIG. 16 shows the same sixth variation seen partly in section on line XVI—XVI of FIG. 15.

In the sixth variation, illustrated in FIGS. 15 and 16, an insulating support 2c supports two identical connection devices arranged in the vicinity of each other. Each of the latter comprises a tubular connection member 1 whereof the second end part 12 is housed in a second half-socket 22 and whereof the first end part 11 and the connecting part 15 are housed in the insulating support 2c. The first end part 11 comprises at least one additional transverse slot 11c, which is for example secant with respect to the first slot 11a (FIG. 16), and adapted to receive at least one additional conducting member formed for example by a strip 13a housed in an additional transverse passage 34 provided in the insulating support. In this example, the transverse passage 34 passes through the insulating support 2c and connects the two connection devices. In this variation, the mushroom-shaped part 28 and the conical part 9 are provided in the bottom of the housing 23 of the insulating support 2c, in order to cause wedging of the first end part 11 and tightening of this part 11, simultaneously on the cable 13 and on the strip 13a. The additional strips 13a are both housed in the passage 34 and are in contact with each other at a point 34a, for example. It will be noted that each strip 13a and the corresponding first end part 11 are connected directly to each other, while each being connected directly to the cable 13. The connection cable 13 and strip 13a are connected by means of a slot 13b provided in the latter, which slot has the same width as the slots 11a and 12a (FIG. 15).

Figure 17:
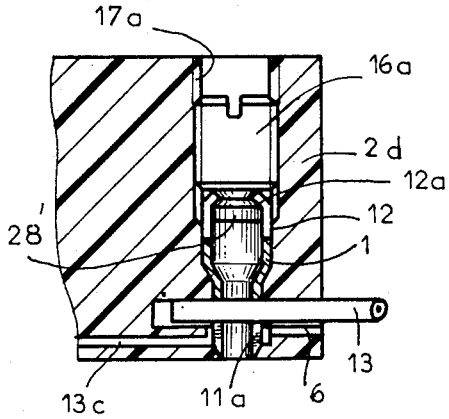
FIG. 17 shows a second embodiment of the invention in section.

In the second embodiment of the invention, illustrated in FIG. 17, the tubular connection member 1 is mounted to slide solely in an insulating support 2d in which it may slide axially but not rotate, as in the first embodiment (FIGS. 1 to 16). The movement means, provided for ensuring individually the connection between the first transverse slot 11a of the tubular connection member 1 and a cable 13, comprises an operating screw 16a cooperating with an internal screwthread 17a provided in the same insulating support 2d in the extension of the second end part 12 of the tubular connection member 1. The split end 12a of the second end part 12' is rendered integral, axially but not angularly, with the end of the screw 16a, for example by partial folding of the split end 12a on a mushroom 28' provided at the end of the screw 16a. The transverse passage 6 is provided for example in order to emerge on a side face of the insulating support 2d.

A connection device of this type can be used for connecting a cable 13 to an output circuit 13c of an electrical appliance of which the insulating support 2d forms part.

In the third embodiment of the invention, illustrated in FIGS. 18 to 21 and 24, the tubular connection member 1 described previously remains unchanged, with the exception of its cross-section which is circular. The two half-sockets 21 and 22 constituting the socket 20 described previously are replaced by a one-piece insulating socket 40 attached to the insulating socket 2 of which it forms part. It is provided in order to contain the tubular connection member 1. The first end part 11 of the latter projects partially from the first end of the insulating socket 40. This insulating socket 40 has a first end part 41 whereof the dimensions are just less than the inner transverse dimensions of a tubular extension 45 of the second end part 42 opposite the first. This extension 45 projects beyond the second end of the tubular connection member 1 and has internal transverse dimensions which are at lease equal to the outer dimensions of the second end part 12 of the tubular connection member 1.

The inner periphery of the tubular extension 45 is intended to cooperate with the movement means provided for ensuring individually the connection between the second transverse slot 12a of the tubular connection member 1 and a cable 14 located in the corresponding transverse passage 56. These movement means are constituted by an operating screw 16b cooperating with a corresponding internal screwthread 17b (FIGS. 18 and 20) provided on the inner periphery of the tubular extension 45. The transverse passage 56 is extended transversely with respect to the tubular extension 45 and emerges on the second end of the insulating socket 40.

Figure 18:
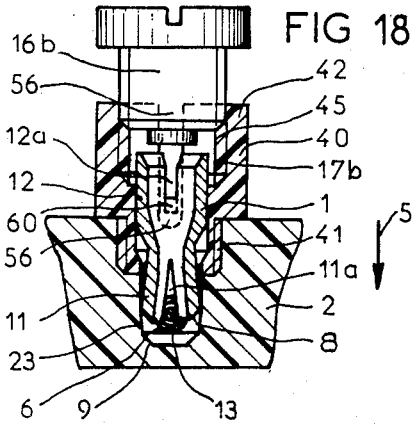
FIGS. 18 to 21 show a third embodiment of the invention, at various stages of use, in section.

In this embodiment, the base of the housing 23 of the insulating support 2, which receives the first end part 11 of the tubular connection member 1, does not comprise the mushroom-shaped part 28 described in certain preceding embodiments, but solely comprises the conical part 9 (FIG. 18).

Figure 24:
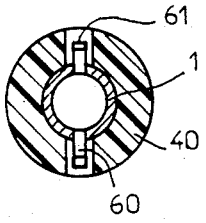
FIG. 24 shows the same third embodiment and its variation in section on line XXIV—XXIV of FIGS. 21 and 22.

In this embodiment, the guide means provided for allowing a relative axial but non-angular movement between the insulating support defined by the socket 40 and the tubular connection member 1 are formed, as illustrated in FIG. 24, by a burr 60 extending in the vicinity of the second self-stripping transverse slot 12a. This burr 60 is housed in a corresponding housing 61 provided in the insulating socket 40 forming part of the insulating support 2.

All the other features are identical to those of the first embodiment (FIGS. 1 to 5).

Figure 19:
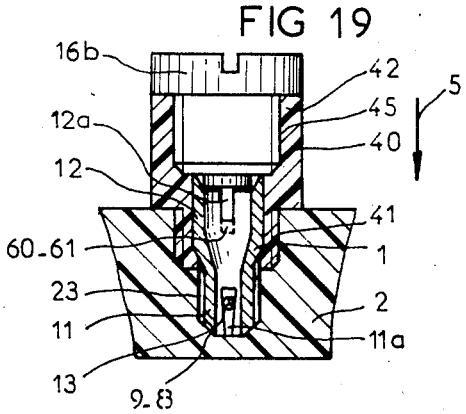
Figure 20:
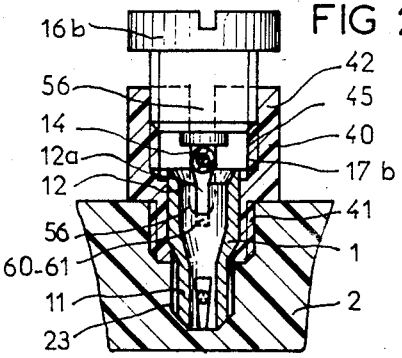
Figure 21:
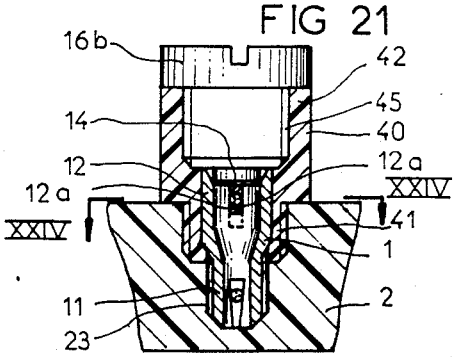

After the socket 40 is screwed into its insulating support 2, the cable 13 is introduced into the transverse passage 6 (FIG. 18). Then the tubular connection member 1 is inserted in its socket 40 by initially housing the burr 60 in the transverse passage 56. The first transverse slot 11a (FIG. 18), which is slightly open in this embodiment bears against the cable 13. The screw 16b is then screwed into the extension 45 and, as illustrated in FIG. 19, it drives the tubular connection member 1 in the direction of arrow 5 on the cable 13, the burr 60 finally being housed in its housing 61. At the end of this travel, the two cones 9 and 8 cooperate in order to close the slot 11a around the cable 13 (FIG. 19) which is for example a multi-core cable. A semipermanent connection is thus produced. The screw 16b is then loosened and, as illustrated in FIG. 20, the cable 14 is introduced into the passage 56, at the entrance of the second slot 12a of the first end part 12. The screw 16b is then rotated once more in order to push, as shown in FIG. 21, the cable 14 into the second slot 12a. A temporary connection is thus provided.

Without diverging from the scope of the present invention, the screw 16b could be replaced by a second insulating socket 40 which, like the first, would be screwthreaded externally on its first end part 41.

Figure 23:
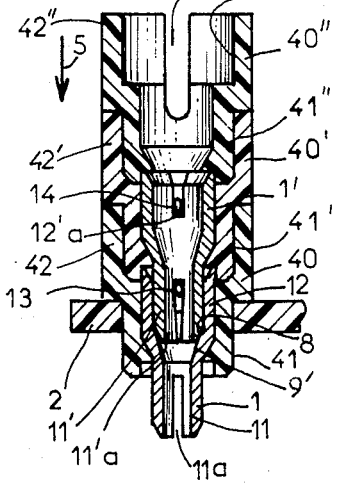
FIGS. 22 and 23 show a variation of the third embodiment at various stages of use, in section.
Figure 22:
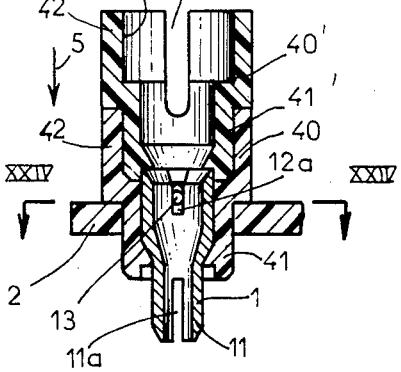

In the first variation of the third embodiment, illustrated in FIGS. 22 to 24, the insulating sockets 40,40' . . . have a first end part 41,41' . . . which is smooth, instead of being screwthreaded, and the same is true for the inner periphery of the extension 45. In this variation, the movement means, provided for ensuring individually the connection between the second transverse slot 12a of the tubular connection member 1 and each cable 13,14, include a push-rod formed by the first smooth end part 41' of a second socket 40'.

The longitudinal dimension of the tubular extension 45 of the second end part 42,42' . . . of each insulating socket 40,40' . . . is advantageously greater than or equal to the longitudinal dimension of the portion of the first part 11 of the tubular connection member 1, projecting from the first end of the insulating socket 40,40' . . . in order to allow the disconnection of a cable previously connected to the first slot 11*a* of a tubular connection member 1.

All the other parts are identical to those of the third embodiment described previously (FIGS. 18 to 21).

After the first socket 40 is driven into the remainder of the insulating support 2, as shown in FIG. 22, a tubular connection member 1 is housed in this socket 40 by sliding in the direction of arrow 5. The cable 13 is presented to the entrance of the second slot 12 and then is pushed into the latter by the end of a second socket 40' moved in the direction of arrow 5.

As illustrated in FIG. 23, another tubular connection member 1' is introduced into this socket 40' and into the second end part 12 of the first tubular connection member 1 until its first slot 11'*a* is in contact with the cable 13. A pushing action in the direction of arrow 5 is then exerted by a third socket 40'' on the member 1' and the cable 13 is thus driven not only into the slot 12*a* but also into the slot 11'*a* of the first end part 11' which is tightened under the effect of the cone 9' cooperating with its cone 8, as in the variation already described (FIGS. 7 to 9). A permanent connection is thus achieved. After the third socket 40'' is withdrawn, a cable 14 can be placed at the entrance to the second slot 12'*a* of the second tubular connection member 1'. The cable is then introduced into this slot 12'*a* by a new pushing action in the direction of arrow 5, by the third socket 40''. A provisional connection is thus achieved.

After having removed the third socket 40'' and having manually disconnected the cable 14, it is also possible to remove the second half-socket 40' at the same time as the tubular connection member 1' in the slot 11'*a* of which the cable 13 remains connected. It is sufficient to exert a pressure on the second end of the socket 40' by pressing the first end of the member 1 on a support point so that the first end of the socket 40' removes the cable 13 from its slot 11'*a*.

Figure 25:
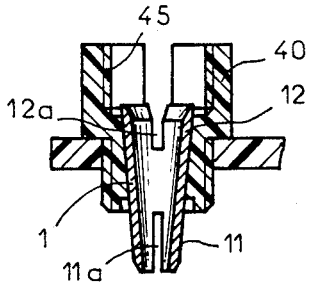
FIG. 25 shows a second variation of the third embodiment, in section.

In the second variation of the third embodiment, illustrated in FIG. 25, the tubular connection member 1 is conical in shape and this conicity is such that the outer transverse dimensions of its first end part 11 correspond to the inner transverse dimensions of its second end part 12, as is the case for all the other embodiments described previously. The operation of this arrangement is similar to those of the previously disclosed embodiments.

In the various constructions, it will be noted that multi-core cables can be used where the first end parts 11,11' are tightened around the cable 13 at the end of the connection. Furthermore, a single basic connection system, formed essentially by the tubular connection member 1 or 1', makes it possible to produce various connection devices which necessitate the intervention of an operator solely on one of their faces. In addition, the individual insulation of each device is improved in order to ensure a certain tightness, in particular in the first embodiment (FIGS. 1 to 13) in which the half-sockets 21,22 are placed one against the other, all the conducting parts being isolated from the external atmosphere.

A method for the manufacture of the connection device, according to the present invention, consists of producing sections of tube intended to form tubular connection members 1. The latter may be both completely closed sections of tube as well as sections produced by rolling. These sections are then stamped in order to obtain the different transverse dimensions of their two opposed end parts 11,12. Then the slots 11*a*,12*a* are produced by recessing in a direction parallel to the tubular member 1, by means of the set of tools shown in FIG. 26.

This set of tools comprises a first part 71 provided with a housing intended to receive the first end part 11 of a tubular connection member 1. Fixed rigidly and transversely across this housing is a blade 74 having the width of the first slot 11*a* which it is to produce. The the second movable part 72 of the tool, located facing the first part 71, comprises a rigid shaft 75 whose outer transverse dimensions are just less than the inner dimensions of the second end part 12 of the member 1. A rigid wire 78, having a diameter equal to the width of the second transverse slot 12*a*, is supported rigidly transversely with respect to the shaft 75 and its two free ends are fixed in the part 72 of the tool.

Figure 26:
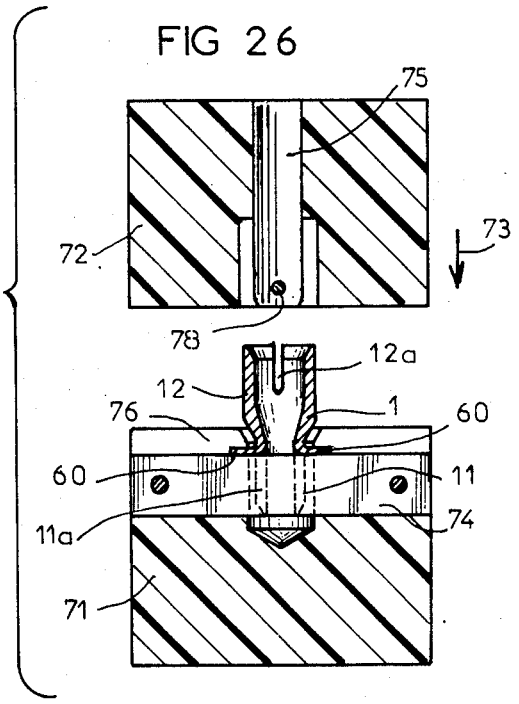
FIG. 26 shows how the method of manufacture according to the present invention is carried out.

In order to effect recessing of the slots 11*a* and 12*a*, the blank of the member 1 is placed in the housing of the first part 71. Then a movement in the direction of arrow 73 of the second part 72 towards the first causes the recessing to the two slots 11*a*,12*a* by the blade 74 and by the wire 78. A recess 76 facilitates the creation of the burr 60, outside the tubular connection member 1 in this example, if this burr 60 is to be produced. In FIG. 26, the second part 72 of the tool is shown in the retracted position, after recessing.

The tubular connection member produced in this way may possibly be fitted in advance in a previously produced insulating socket 40, for example by moulding a thermoplastics material.

What is claimed is:

1. An electrical connection device, comprising:

an electrically insulating support;

at least one tubular, electrically conductive connection member mounted on the insulating support and axially movable with respect thereto;

the at least one connection member including a first end part, and a second end part opposite the first end part;

the first end part having formed therein a first transverse slot;

the second end part having formed therein a second transverse slot;

each of the first and second transverse slots being adapted to self-strip and receive an electrical cable;

the insulating support having formed therein a passage disposed to face at least the second transverse slot and adapted to receive an electrical cable;

means for axially guiding the at least one connection member during relative movement of the at least one member and the insulating support; and means for moving the at least one connection member relative to the insulating support from a first position to a second position to allow the at least one connection member to engage an electrical cable received by the passage, the moving means being engageable; with the insulating support to effect movement of the at least one conductive connection member and to effect engagement of the at least one connection member with an electrical cable received by said passage, the moving means being selectively removable from engagement with the insulating support to allow at least one other conductive connection member to be mounted on the insulating support.

2. An electrical connection device according to claim 1, characterised in that the guide means provided for allowing a relative axial movement between the insulating support and the at least one tubular connection member include an extension arranged in proximity to at least the second selfstripping transverse slot of the at least one connection member, the extension being housed in a corresponding housing formed in the insulating support.

3. An electrical connection device according to claim 1, characterised in that the movement means, provided for ensuring individually the connection between the first transverse slot of the at least one tubular connection member and a cable, includes an operating screw cooperating with an internal screwthread provided in the insulating support, the operating screw acting as an extension of the second end part of the at least one tubular connection member, the split end of the second end part being rendered integral axially with the end of the screw.

4. An electrical connection device according to claim 1, characterised in that the first end part of the at least one tubular connection member comprises at least one additional transverse slot able to receive at least one additional electrical cable; and wherein the insulating support has formed therein an additional transverse passage adapted to receive an electrical cable.

5. An electrical connection device according to claim 1, in which the insulating support further includes an insulating socket for containing the at least one tubular connection member, the insulating socket including a first half-socket and a second half-socket, intended to be placed on against the other, for keeping the at leat one tubular connection member in position axially, at least one of the first half-socket and second half-socket defining a housing having two opposite ends that are at least partly closed off, the second half-socket containing the second end part of the at least one tubular connection member, the first half-socket containing the first end part of the at least one tubular connection member, the movement means, including the passage formed in the insulating support, the passage being formed with an orifice closed over its entire periphery.

6. An electrical connection device according to claim 5, wherein the insulating support further includes an intermediate portion interposed between the first and second half-sockets, the intermediate portion having formed therein a housing adapted to receive the at least one tubular connection member.

7. An electrical connection device according to claim 6, wherein at least one of the first and second half-sockets has formed therein a passage extending transversely of its respective one of the first and second insulating half-sockets in which it is formed, the passage being formed with an end portion that is bent in the direction of the intermediate portion; and wherein the intermediate portion has formed therein a housing, the housing being aligned and communicating with the bent end portion of the passage.

8. An electrical connection device according to claim 7, which further comprises an electrically insulating case adapted to receive the first and second half-sockets, the case having a first end that is integrally mounted on the insulating support, and a second end opposite the first end, the first and second half-sockets being axially movable within the case, the case having formed therein an abutment limiting the axial movement of the first half-socket in the direction of the first end of the case, the second half-socket having a passage formed therein extending transversely thereto, the passage being formed with a first end portion that is bent in the direction of the first end of the case, the passage of the second half-socket being formed with a second end portion opposite the first end portion, the case having a wall, a recess being provided across the wall of the case, facing the second end portion of the transverse passage of the second half-socket, the movement means being disposed near the second end of the case, the movement means including an operating screw cooperating with an screwthread provided internally in said second end of the case.

9. An electrical connection device according to claim 8, which further includes at least one intermediate half-socket similar to the second half-socket and interposed between the first and the second half-socket, the at least one intermediate half-socket having formed therein an axial inner housing, the axial inner housing having a first end and a second end opposite the first end, the axial inner housing of the at least one intermediate half-socket being dimensioned to recieve the at least one tubular connection member.

10. An electrical connection device according to claim 9, characterised in that the passage formed in the second half-socket extends transversely with respect to the intermediate half-socket; and wherein the first half-socket has formed therein a passage which extends longitudinally through the first half-socket in the direction of the first end of the case and which is aligned and communicating with the bent first end portion of the passage formed in the second half-socket.

11. An electrical connection device according to claim 1, in which the insulation support includes an attached insulating socket provided for containing the at least one tubular connection member, the insulating socket having a first end part and a second end part opposite the first end part, the second end part of the socket including a tubular extension, the first end part of the socket having outer transverse dimensions that are just less than the inner transverse dimensions of the tubular extension of its second end part, the extension projecting beyond the second end part of the at least one tubular connection member and having transverse dimensions at least equal to the outer dimensions of the second end part of the at least one tubular connection member, the inner periphery of the tubular extension being intended to cooperate with the movement means.

12. An electrical connection device according to claim 11, characterised in that the movement means provided to facilitate the connection between the second transverse slot of the at least one tubular connection member and a cable includes a second insulating socket having a screwthread formed externally on its first end part that cooperates with a corresponding internal screwthread provided on the inner periphery of the tubular extension of the second end part of the insulating socket attached to the insulating support.

13. An electrical connection device according to claim 11, characterised in that the movement means includes a second insulating socket adapted to move axially inside the tubular extension of the insulating socket attached to the insulating support.

14. An electrical connection device according to claim 11, characterised in the longitudinal dimension of the tubular extension of the second end part of the insulating socket is at least equal to the longitudinal dimension of the portion of the first end part of the at least one tubular connection member in order to allow the disconnection of a cable connected in the first transverse slot of the at least one tubular connection member.

15. An electrical connection device, which comprises:

an electrically insulating support;

first and second tubular, electrically conductive connection members mounted on the insulating support and axially movable with respect thereto;

each of the first and second connection members including a first end part and a second end part opposite the first end part;

the first end part of each of the first and second connection members having formed therein a first transverse slot;

the second end part of each of the first and second connection members having formed therein a second transverse slot;

each of the first and second transverse slots of the first and second connection members being adapted to self-strip and receive an electrical cable;

the first connection member being co-axial with the second connection member, the first and second connection members being arranged so that the first end part of the second connection member is proximal to the second end part of the first connection member, and the second end part of the second connection member is distal from the first end part of the first connection member;

the first end part of the second connection member having a diameter that is less than that of the second end part of the first connection member, to allow the first end part of the second connection member to be telescopically received by the second end part of the first connection member;

the insulating support having formed therein a passage disposed to face at least the second transverse slot in the first connection member and adapted to receive an electrical cable;

means for axially guiding the first and second connection members during relative movement of the first and second connection members and the insulating support; and means for axially moving each of the first and second connection members relative to the insulating support from a first position to a second position to allow the first connection member to engage an electrical cable received by the passage and to allow the second connection member to engage an electrical cable interposed between the first connection member and the second connection member, the moving means being engagable with the insulating support to effect movement of the first and second connection members and to effect engagement of the first and second members with respective electrical cables, the moving means being selectively removable from engagement with the insulating support to allow at least the second connection member to be removed from the insulating support.

16. An electrical connection device according to claim 15, characterised in that the respective longitudinal dimensions of the first end part of the second connection member and of the second end part of the first connection member are such that, when the first end part of the second connection member is fully inserted in the second end part of the first connection member the first slot of the second connection member and the second slot of the first connection member are arranged transversely one as an extension of the other in order to be able to be connected together to at least one cable.

17. An electrical connection device according to claim 15, characterised in that the second end part of the first tubular connection member and the end of the first end part of the second tubular connection member, which is housed in said second end part of the first connection member, are in the form of cones in order to cooperate with each other, when the first end part of the second tubular connection member is received by the second end part of the first tubular connection member, in order to close at least partly, in a resilient manner, the transverse slot in the first end part of the second connection member on a cable.

18. An electrical connection device according to claim 15, wherein the insulating support includes an inner part which receives an end of the first end part of the first connection member; and wherein the end of the first end part of the first tubular connection member and the bottom of the inner part of the insulating support, which receives said first end part, are in the form of cones, in order to cooperate one with the other when the first end part is received by the inner part of the insulating support in order to close at least partly the first transverse slot of the first connection member on a cable.

19. An electrical connection device according to claim 18, characterised in that the conically shaped bottom of the inner part of the insulating support, intended to cooperate with the first end part of the first tubular connection member, comprises a central axial part in the shape of a mushroom, arranged in order to wedge the first end part of the first connection member, between the conically shaped bottom and the mushroom shaped part, when the first end part of the first connection member is received by the insulating support, in order to render the first end part of the first connection member integral with the insulating support.

* * * * *